US010575639B2

(12) United States Patent
Liu et al.

(10) Patent No.: US 10,575,639 B2
(45) Date of Patent: Mar. 3, 2020

(54) HOUSEHOLD APPLIANCE

(71) Applicant: BSH HAUSGERAETE GMBH, Munich (DE)

(72) Inventors: Qinchao Liu, Nanjing (CN); Ping Lv, Nanjing (CN); Ya Xu, Nanjing (CN); Chuan Zhang, Chuzhou (CN); Oliver Elser, Koenigsbronn (DE); Roland Kuemmel, Nellingen (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/286,668

(22) Filed: Feb. 27, 2019

(65) Prior Publication Data

US 2019/0269242 A1 Sep. 5, 2019

(30) Foreign Application Priority Data

Mar. 1, 2018 (CN) ..... 2018 1 0173545

(51) Int. Cl.
*A47B 88/956* (2017.01)
*A47B 88/95* (2017.01)

(52) U.S. Cl.
CPC ..... *A47B 88/956* (2017.01); *A47B 2088/952* (2017.01)

(58) Field of Classification Search
CPC ..... A47B 88/956; A47B 2088/952; F25D 25/025
See application file for complete search history.

(56) References Cited

U.S. PATENT DOCUMENTS 4,090,753 A * 5/1978 Rock ..... A47B 88/956 248/243
6,390,576 B1 * 5/2002 Walburn ..... A47B 88/956 312/348.1
6,447,083 B1 * 9/2002 Chiapetta ..... F25D 23/04 312/334.4
6,561,605 B1 * 5/2003 Akers ..... A47B 88/956 29/464
9,841,221 B2 * 12/2017 Dubina ..... F25D 23/067
(Continued)

FOREIGN PATENT DOCUMENTS

JP 2017086866 A * 5/2017 ..... A47B 88/95

*Primary Examiner* — Hanh V Tran
(74) *Attorney, Agent, or Firm* — Laurence A. Greenberg; Werner H. Stemer; Ralph E. Locher

(57) ABSTRACT

A household appliance includes a connection mechanism fixing a door and a main body. The connection mechanism includes first and second components fixed by first and second fixing mechanisms. The first mechanism includes a first fixing member, a first hole on the first component and a second hole on the second component. The second mechanism includes a second fixing member, third holes elongated in a second direction at intervals on the first component and fourth holes at intervals in a first direction on the second component. When the second fixing member passes through a third hole and a fourth hole, the third and fourth holes define a distance between centers of remaining third holes and centers of remaining fourth holes in the first direction. The fourth holes adjust positions relative to the third holes in the second direction, causing the first and second components to relatively rotate.

20 Claims, 11 Drawing Sheets

(56) References Cited

U.S. PATENT DOCUMENTS

| | | | | |
|---|---|---|---|---|
| 2002/0153816 | A1* | 10/2002 | Banicevic | F25D 23/04 312/404 |
| 2004/0000852 | A1* | 1/2004 | Lam Harn | A47B 88/956 312/348.4 |
| 2007/0182293 | A1* | 8/2007 | Compagnucci | A47B 88/956 312/334.4 |
| 2008/0067303 | A1* | 3/2008 | Compagnucci | A47B 96/068 248/201 |
| 2008/0074019 | A1* | 3/2008 | Park | F25D 23/028 312/236 |
| 2009/0026906 | A1* | 1/2009 | Kim | F25D 25/025 312/401 |
| 2009/0289537 | A1* | 11/2009 | Cabal Velarde | A47B 88/956 312/408 |
| 2010/0007249 | A1* | 1/2010 | Brown | F25D 23/021 312/109 |
| 2014/0239787 | A1* | 8/2014 | Mensa' | A47B 88/956 312/348.4 |
| 2015/0282617 | A1* | 10/2015 | Chen | A47B 96/06 312/348.4 |
| 2016/0174713 | A1* | 6/2016 | Dubina | F25D 25/025 312/334.8 |
| 2017/0176088 | A1* | 6/2017 | Richards | F25D 23/028 |
| 2017/0241698 | A1* | 8/2017 | Dubina | F25D 23/067 |

* cited by examiner

HOUSEHOLD APPLIANCE

CROSS-REFERENCE TO RELATED APPLICATION

This application claims the priority, under 35 U.S.C. § 119, of Chinese Patent Application CN 2018 1017 3545.0, filed Mar. 1, 2018; the prior application is herewith incorporated by reference in its entirety.

BACKGROUND OF THE INVENTION

Field of the Invention

The present invention relates to a household appliance and, in particular, a household appliance having an adjustment mechanism.

Description of the Related Art

A household appliance, for example, a refrigerator, includes a main body and a door that can move relative to the main body to open or close the door. During use, a position of the door relative to the main body may change. For example, under the force of gravity, after the household appliance has been used for a period of time, the position of the door deviates downward. When the position of the door relative to the main body deviates to a degree, a gap may appear between a sealing gasket disposed on the door and the main body, resulting in leakage of coldness inside the refrigerator to the outer environment.

In addition, an improper positional relationship between the door and the main body affects an appearance of the household appliance.

SUMMARY OF THE INVENTION

It is accordingly an object of the invention to provide a household appliance, which overcomes the hereinaforementioned disadvantages of the heretofore-known appliances of this general type and with which a positional relationship between a door and a main body can be adjusted.

With the foregoing and other objects in view there is provided, in accordance with the invention, a household appliance, including a main body, a door connected to the main body, and a connection mechanism configured to fix the door to the main body, in which the connection mechanism includes a first component and a second component as well as a first fixing mechanism and a second fixing mechanism configured to fix the first component and the second component. The first fixing mechanism includes a first hole located on the first component, a second hole located on the second component, and a first fixing member passing through the first hole and the second hole to fix the first component and the second component. The second fixing mechanism includes a second fixing member, a group of third holes located on the first component, and a group of fourth holes located on the second component, in which the third holes are disposed at intervals in a first direction, the fourth holes are disposed at intervals in the first direction, and the third holes and the fourth holes are disposed in such a manner that when the second fixing member passes through any one of the third holes and any one of the fourth holes corresponding to the third holes, there is a distance between centers of the rest of the third holes and centers of the rest of the corresponding fourth holes in the first direction. The third holes are elongated holes extending in a second direction, and the fourth holes are suitable to adjust positions relative to the third holes in the second direction, so that the first component and the second component rotate relatively around the first fixing member, to adjust a position of the door relative to the main body when the door is closed.

A plurality of third holes is disposed at intervals on the first component of the connection mechanism in the first direction, and a plurality of fourth holes is disposed at intervals on the second component in the first direction, so that different third holes coordinate with and are connected to corresponding fourth holes, to adjust relative positions between the first component and the second component in the first direction, that is, to adjust relative positions between the door and the main body in the first direction.

If the first direction is a height direction of the household appliance, a height position of the door relative to the main body can be adjusted, thereby effectively resolving a problem such as a coldness leakage of the refrigerator to an outer environment caused due to a gap between the door and the main body, where the gap is caused because the household appliance has been used for a long time or has been improperly assembled, and consequently, the door deviates upward or downward relative to the main body.

In addition, the third holes are elongated or prolonged holes in the second direction, and the fourth holes are suitable to adjust the relative positions to the corresponding third holes in the second direction, so that the first component and the second component can relatively rotate around the first fixing member, that is, the door can be rotatably adjusted.

If the second direction is a front-rear direction of the household appliance, gaps at partial positions between the door and the main body can be adjusted. When the door tilts relative to the main body because the household appliance has been used for a long time or has been improperly assembled, the door is adjusted through rotation, so that the door can be restored from a tilted state to a correct state or a balanced position with an acceptable error, thereby avoiding problems such as a coldness leakage of the refrigerator.

Finally, holes on the first component and the second component are used as the first fixing mechanism and the second fixing mechanism. Therefore, no additional component needs to be added, thereby reducing costs.

Optionally, centers of the third holes are on the same line and extend in the first direction. In this way, it is convenient to make a hole on the first component and fixedly mount the second component.

Optionally, the first hole is a kidney-shaped hole, and a major axis of the first hole extends in the first direction.

The first hole is a kidney-shaped hole extending in the first direction, so that a relative position of the second hole to the first hole can be adjusted in the first direction. Therefore, a fixed connection between the first hole and the second hole through the first fixing member does not affect position adjustment of the first component and the second component in the first direction.

Optionally, the major axis of the first hole and centers of the third holes are on the same line.

Therefore, when the second hole changes the relative positions between the first component and the second component in the first direction, the centers of the fourth holes can be overlapped with the centers of the third holes. This facilitates the position adjustment between the first component and the second component.

Optionally, the first direction is perpendicular to the second direction.

Optionally, the third holes are kidney-shaped holes, and extension directions of major axes of the third holes are in the second direction; or the third holes are arc holes bending toward the first hole, and major axes of the third holes are arc segments surrounding the first hole.

When the third holes are kidney-shaped holes, a distance between a position of the kidney-shaped hole and the center of the first hole varies, so that changes in relative positions between the fourth holes and the third holes are relatively limited, thereby limiting a rotation amplitude between the first component and the second component. When the third holes are arc holes, the rotation amplitude between the first component and the second component is not limited, thereby increasing an adjustment amplitude of the door relative to the main body.

Optionally, the first fixing member is a screw; and/or the second fixing member is a screw.

Optionally, the first component is further provided with a first positioning hole, the second component is provided with a second positioning hole corresponding to the first positioning hole, when aligned with each other, the first positioning hole and the second positioning hole are suitable to receive a removable positioning member, and when the first positioning hole and the second positioning hole are aligned with each other, the first fixing member is suitable to pass through the first hole and the second hole, and the second fixing member is suitable to pass through one of the third holes and one of the corresponding fourth holes, so that the first component and the second component are at initial relative positions.

The first positioning hole, the second positioning hole, and a positioning member are disposed in such a way that the relative positions between the first component and the second component can be fixed before the connection mechanism is assembled, thereby facilitating fixed mounting of the first component and the second component. In addition, the positioning member is a removable positioning member, After the first component and the second component are fixedly mounted, the positioning member is removed, and the adjustment of the relative positions between the first component and the second component is not affected.

Optionally, the first positioning hole and the second positioning hole are both located between the first fixing mechanism and the second fixing mechanism.

Optionally, the first positioning hole is a non-round hole.

Optionally, the first positioning hole is a kidney-shaped hole. Therefore, it can be avoided that the first hole and the second hole cannot be aligned, and the third hole and the fourth hole cannot be aligned because the first component and the second component relatively rotate, after the positioning member is inserted into the first positioning hole and the second positioning hole, by using the positioning member as a center.

Optionally, a major axis of the first positioning hole extends in the first direction.

Optionally, a center of the first hole and the centers of the third holes are on the same line, and the first hole and the third holes extend in the first direction, and a major axis of the first positioning hole is located on a line connecting the center of the first hole and the centers of the third holes, or is parallel to a line connecting the center of the first hole and the centers of the third holes.

Inserting a positioning member having a constant thickness and a relatively small width into the first positioning hole and the second positioning hole can define relative positions between the first component and the second component in the second direction, thereby facilitating the adjustment of the relative positions between the first component and the second component in the first direction.

Optionally, the first positioning hole and the second positioning hole have the same shape and size. The first positioning hole and the second positioning hole are able to have the same shape and size, and moreover, an outline of the positioning member is also able to have the same shape and size as those of the first positioning hole and the second positioning hole. When the positioning member is inserted into the first positioning hole and the second positioning hole, there will be no gap between the first positioning hole and the outline of the positioning member and between the second positioning hole and the outline of the positioning member, and the first component and the second component will not relatively move due to an existence of a gap.

Optionally, at the initial relative positions, centers of the first hole and the second hole are overlapped.

Optionally, at the initial relative positions, the second fixing member is suitable to pass through one third hole located in the middle in the group of third holes and a corresponding fourth hole. Therefore, the relative positions between the first component and the second component can be conveniently adjusted in the first direction, and a height of the door relative to the main body can be conveniently adjusted.

Optionally, at the initial relative positions, the center of the third hole located in the middle in the second direction overlaps with the center of the corresponding fourth hole. Therefore, the relative positions between the first component and the second component can be conveniently adjusted in the second direction, and a tilt degree of the door relative to the main body can be conveniently adjusted.

Optionally, the connection mechanism further includes an initial fixing mechanism, which includes a first initial fixing hole located on the first component and a second initial fixing hole located on the second component, where at the initial relative positions, the first initial fixing hole is overlapped with the second initial fixing hole to receive a third fixing member.

The first component and the second component are prefixed by using the initial fixing mechanism, and the first fixing mechanism and the second fixing mechanism fix the first component and the second component again. In this way, the first component and the second component can be effectively prevented from becoming loose, thereby improving connection strength of the first component and the second component.

Optionally, the initial fixing mechanism is located between the first fixing mechanism and the second fixing mechanism.

Other features which are considered as characteristic for the invention are set forth in the appended claims.

Although the invention is illustrated and described herein as embodied in a household appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

In order to make the objectives, features, and advantages of the present invention more comprehensible, the following describes specific embodiments of the present invention in detail with reference to the accompanying drawings.

DETAILED DESCRIPTION OF THE INVENTION

Figure 1:
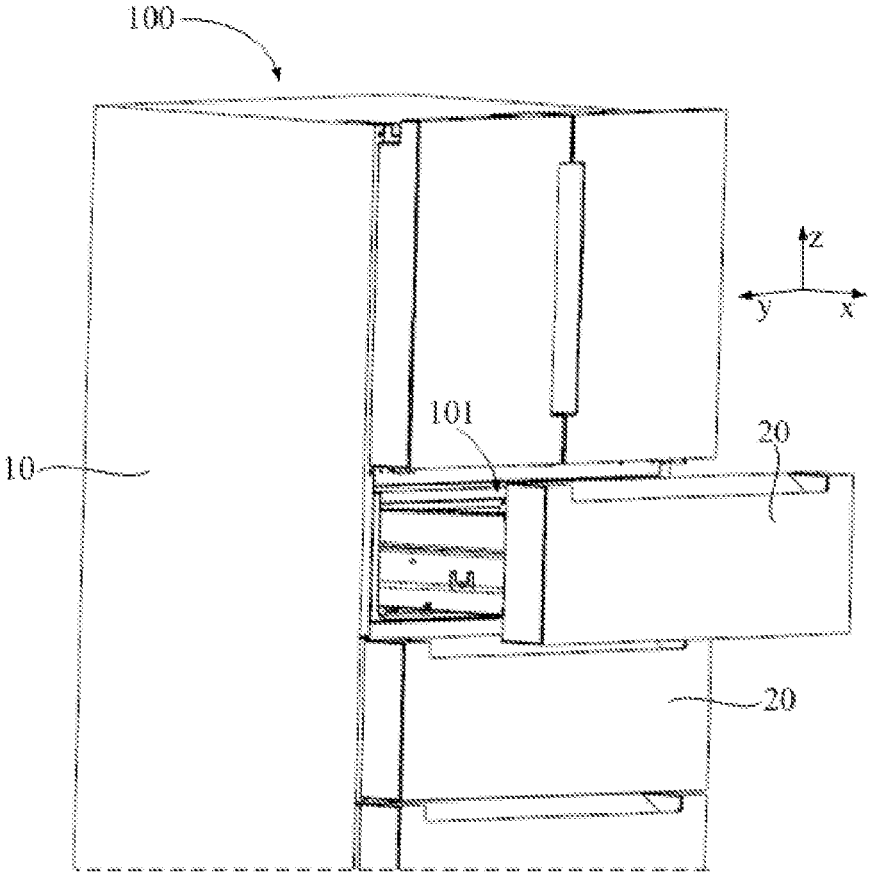
FIG. 1 is a diagrammatic, perspective view of a household appliance according to a specific embodiment of the present invention.

Referring now to the figures of the drawings in detail and first, particularly, to FIG. 1 thereof, there is seen a household appliance 100, for example a refrigerator, which includes a main body 10 having a storage compartment 101 and a door 20 configured to close the storage compartment 101. The door 20 is suitable to slide in a front-rear direction X of the household appliance 100 to open or close at least a part of the storage compartment 101.

Figure 2:
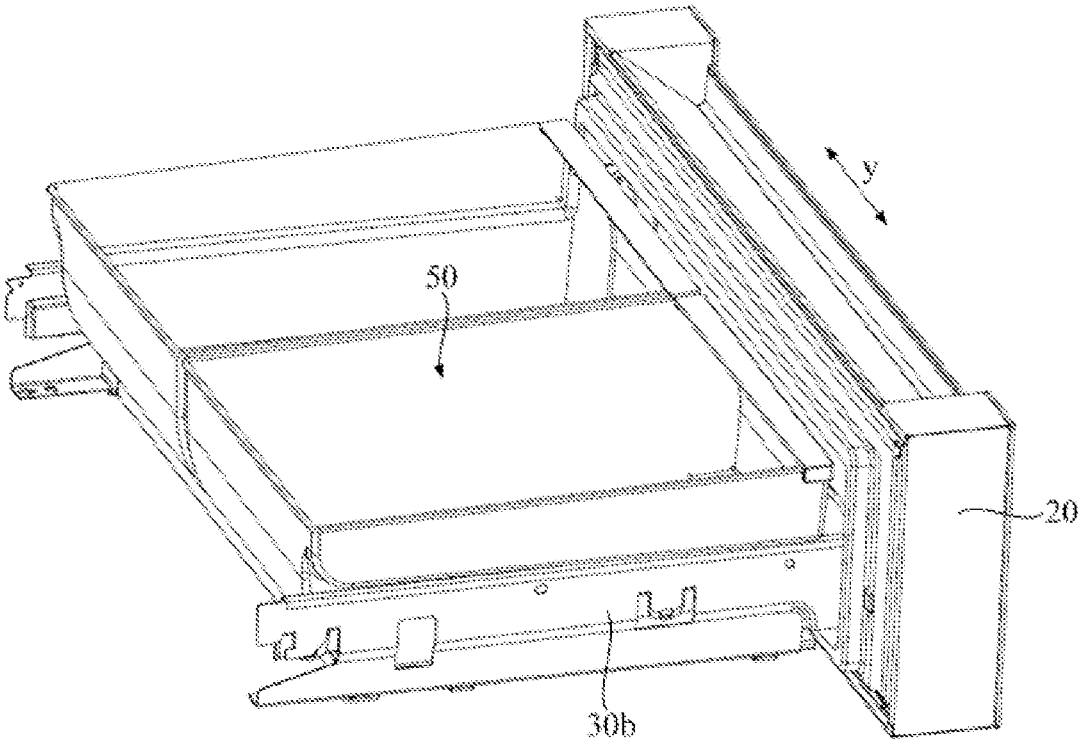
FIG. 2 and FIG. 3 are perspective views showing that a connection mechanism of a household appliance is fixed to a door according to a specific embodiment of the present invention.
Figure 3:
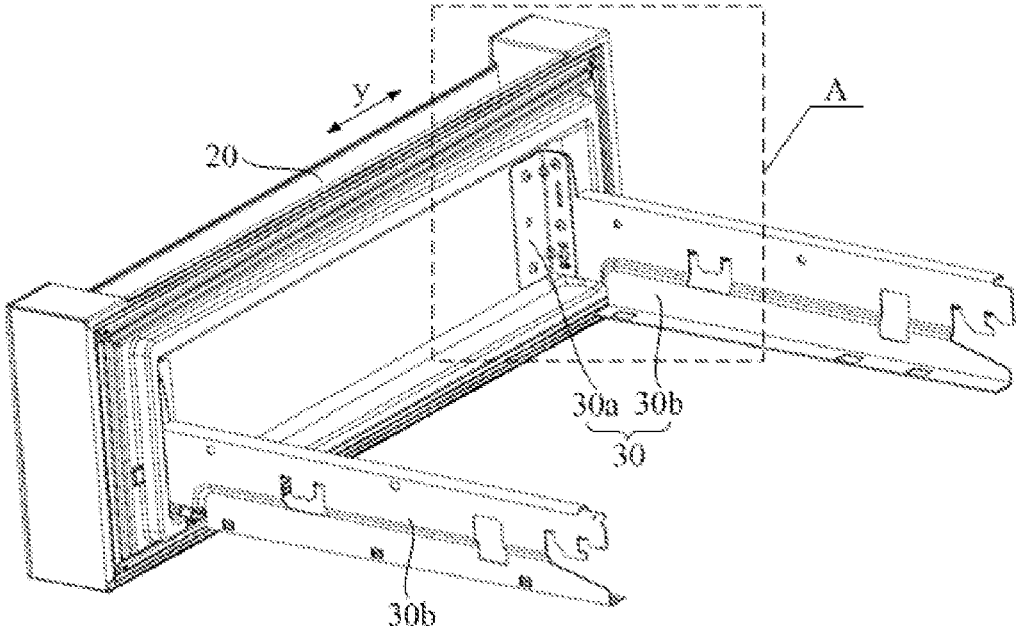
Figure 4:
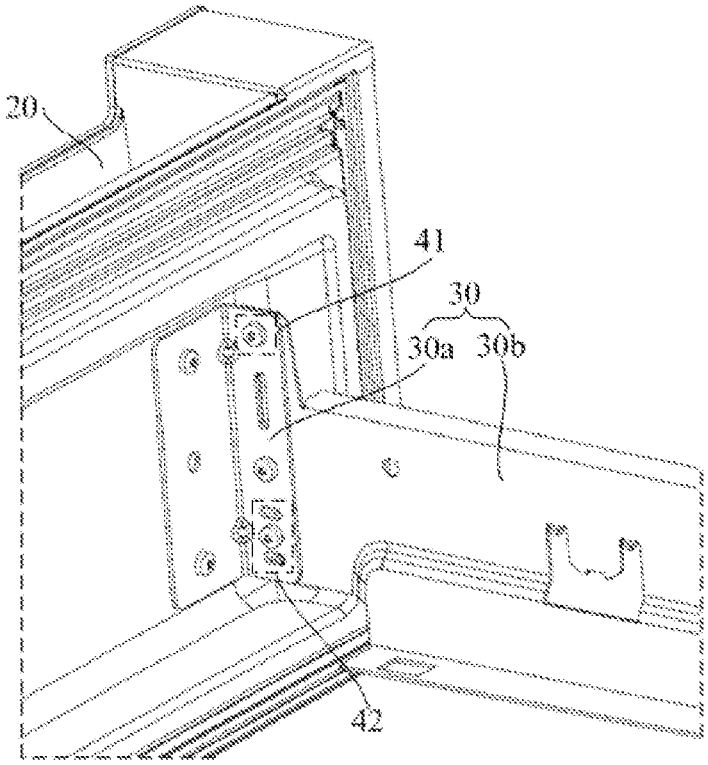
FIG. 4 is a fragmentary, enlarged view of an area A shown in FIG. 3.

As shown in FIG. 2 to FIG. 4, the household appliance 100 further includes a connection mechanism 30. The connection mechanism 30 includes a pair of first components 30*a* fixedly disposed on a rear surface of the door 20 and a pair of second components 30*b* suitable to be disposed on the main body 10. The two first components 30*a* are fixedly disposed on two sides of the door 20 in a width direction y. The two second components 30*b* are respectively disposed corresponding to the two first components 30*a*, In addition, the first component 30*a* and the second component 30*b* that are correspondingly disposed are fixedly connected by using a first fixing mechanism 41 and a second fixing mechanism 42.

The household appliance 100 may further include a container 50 fixedly disposed on a rear side of the door 20. The container 50 may be supported on the connection mechanism 30, and is suitable to move with the door 20.

FIG. 5 to FIG. 8 are diagrammatic illustrations of a connection mechanism 30.

Figure 5:
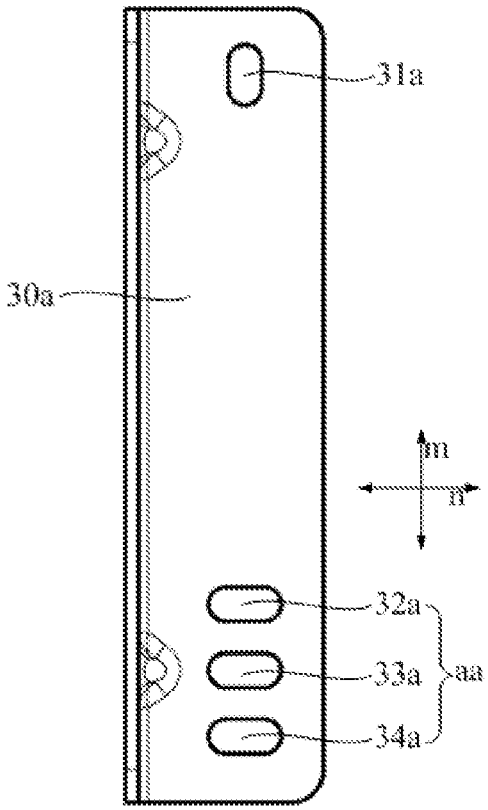
FIG. 5 is an elevational view of a first component in a connection mechanism according to a specific embodiment of the present invention.
Figure 6:
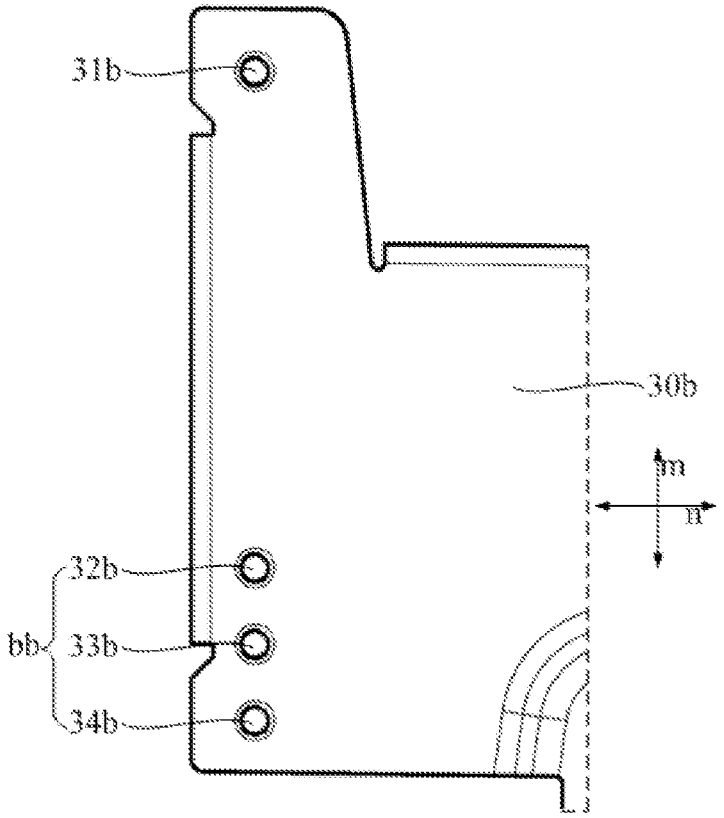
FIG. 6 is an elevational view of a second component in a connection mechanism according to a specific embodiment of the present invention.

As shown in FIG. 5 and FIG. 6, the first component 30*a* is provided with a first hole 31*a* and a third hole group aa.

The third hole group aa includes three third holes 32*a*, 33*a*, and 34*a* disposed at intervals in a first direction m. The second component 30*b* is provided with a second hole 31*b* and a fourth hole group bb. The fourth hole group bb includes three fourth holes 32*b*, 33*b*, and 34*b* disposed at intervals in the first direction m.

Figure 7:
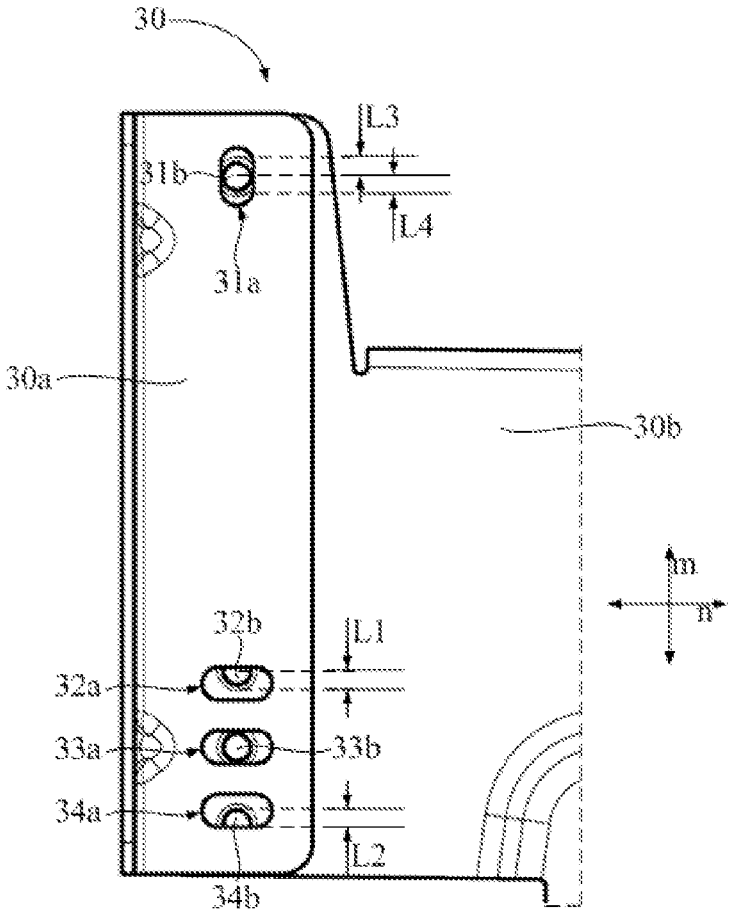
FIG. 7 is an elevational view showing that the first component shown in FIG. 5 and the second component shown in FIG. 6 are fixedly connected, in which a first fixing member and a second fixing member are not shown.
Figure 8:
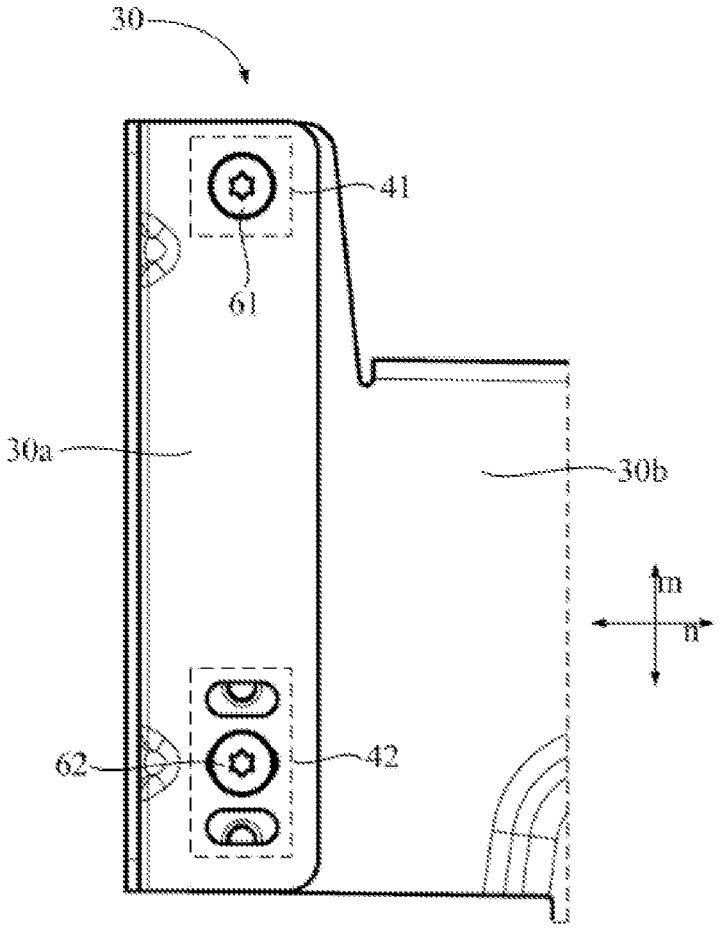
FIG. 8 is an elevational view showing that the first component shown in FIG. 5 and the second component shown in FIG. 6 are fixedly connected, in which a first fixing member and a second fixing member are not shown.

As shown in FIG. 7 and FIG. 8 the first hole 31*a* is suitable to be disposed corresponding to the second hole 31*b*, and a first fixing member 61 can pass through the first hole 31*a* and the second hole 31*b*, to fixedly connect the first component 30*a* and the second component 30*b*. The three third holes 32*a*, 33*a*, and 34*a* are suitable to be respectively disposed corresponding to the three fourth holes 32*b*, 33*b*, and 34*b*, and a second fixing member 62 can pass through one of the third holes 32*a*, 33*a*, and 34*a* and one corresponding fourth hole of the fourth holes 32*b*, 33*b*, and 34*b*, to fixedly connect the first component 30*a* and the second component 30*b*.

The first hole 31*a*, the second hole 31*b*, and the first fixing member 61 form the first fixing mechanism 41. The third hole group aa, the fourth hole group bb, and the second fixing member 62 form the second fixing mechanism 42. Holes on the first component 30*a* and the second component 30*b* are used as a part of the first fixing mechanism 41 and the second fixing mechanism 42. Therefore, no additional component needs to be added, thereby reducing costs.

In this embodiment, when the second fixing member 62 passes through any one of the third holes 32*a*, 33*a*, and 34*a* in the third hole group aa and any one of the corresponding fourth holes 32*b*, 33*b*, and 34*b*, there is a distance between centers of the rest of the third holes 32*a*, 33*a*, and 34*a* and centers of the rest of the corresponding fourth holes 32*b*, 33*b*, and 34*b* in the first direction m.

Referring to FIG. 7 and FIG. 8, the center of the third hole 33*a* in the middle is overlapped with the center of the fourth hole 33*b* in the middle. The second fixing member 62 is suitable to pass through the third hole 33*a* and the fourth hole 33*b*, to fixedly connect the first component 30*a* and the second component 30*b*. In this case, there is a distance L1 between the center of the third hole 32*a* located on an upper portion and the center of the fourth hole 32*b* located on the upper portion in the first direction m, and a center position of the third hole 32*a* is lower than a center position of the fourth hole 32*b*. There is a distance L2 between the center of the third hole 34*a* located on a lower portion and the center of the fourth hole 34*b* located on the lower portion in the first direction m, and a center position of the third hole 34*a* is higher than a center position of the fourth hole 34*b*.

Therefore, when the second fixing member 62 passes through different third holes 32*a*, 33*a*, and 34*a* and the corresponding fourth holes 32*b*, 33*b*, and 34*b* to fixedly connect the first component 30*a* and the second component 30*b*, relative positions between the first component 30*a* and the second component 30*b* can be adjusted in the first direction m.

The first component 30*a* is fixedly disposed on the door 20, and the second component 30*b* is disposed on the main body 10. Therefore, if the first direction m is a height direction z of the household appliance 100, a height position of the door 20 relative to the main body 10 can be adjusted by using the connection mechanism 30. Specifically, when the household appliance 100 has been used for a long time or has been improperly assembled, and consequently, an appearance of the household appliance 100 is affected because the door 20 deviates upward or downward relative to the main body 10, or when a deviation is too large, and consequently, there is a gap between the door 20 and the main body 10, the second fixing member 62 passes through other third holes 32*a*, 33*a*, and 34*a* and corresponding fourth holes 32*b*, 33*b*, and 34*b*, to fixedly connect the first component 30*a* and the second component 30*b*. In this way, a height of the door 20 can be effectively adjusted, so that the door 20 is at a proper position relative to the main body 10.

In this embodiment, the first hole 31*a* is a kidney-shaped hole, and a major axis of the first hole 31*a* extends in the first direction m. When the relative positions between the first component 30*a* and the second component 30*b* in the first direction m need to be adjusted, a relative position of the second hole 31*b* to the first hole 31*a* in the first direction m may be adjusted. Therefore, a fixed connection between the first hole 31*a* and the second hole 31*b* through the first fixing member 61 does not affect position adjustment of the first component 30*a* and the second component 30*b* in the first direction m.

A distance L3 between the center of the first hole 31*a* and a center of an upper hole is not less than a deviation distance L1 between the third hole 32*a* and the fourth hole 32*b*. A distance L4 between the center of the first hole 31*a* and a center of a lower hole is not less than a deviation distance L2 between the third hole 34*a* and the fourth hole 34*b*.

Referring to FIG. 5 and FIG. 7, the third holes 32*a*, 33*a*, and 34*a* are prolonged holes extending in the second direction n. The second direction n is not parallel to the first direction m. In addition, the fourth holes 32*b*, 33*b*, and 34*b* are suitable to adjust relative positions to the corresponding third holes 32*a*, 33*a*, and 34*a* in the second direction n.

Since the first fixing member 61 passes through the first hole 31*a* and the second hole 31*b*, to fixedly connect the first component 36*a* and the second component 30*b*, when relative positions between the fourth holes 32*b*, 33*b*, and 34*b* and the corresponding third holes 32*a*, 33*a*, and 34*a* in the second direction n are adjusted, the first component 30*a* and the second component 30*b* can relatively rotate around the first fixing member 61, to adjust the relative positions between the first component 30*a* and the second component 30*b*.

Similarly, the first component 30*a* is fixedly disposed on the door 20, and the second component 30*b* is disposed on the main body 10. Therefore, if the first direction m is a front-rear direction x of the household appliance 100, a position of the door 20 relative to the main body 10 can be adjusted, when the door 20 is closed, by using the connection mechanism 34. Specifically, when the door 20 tilts relative to the main body 10 because the household appliance 100 has been used for a long time or has been improperly assembled, the relative positions between the fourth holes 32*b*, 33*b*, and 34*b* and the corresponding third holes 32*a*, 33*a*, and 34*a* in the second direction n are changed, so that the door 20 can be restored from a tilted state to a correct state or a balanced position with an acceptable error, thereby avoiding problems such as a coldness leakage of a refrigerator.

In this embodiment, when the household appliance 100 is in a factory-set state, the first component 30*a* and the second component 30*b* are at initial relative positions. At the initial relative positions, as shown in FIG. 6 and FIG. 7, the first fixing member 61 passes through the first hole 31*a* and the second hole 31*b*, to fixedly connect the first component 30*a* and the second component 30*b*. In addition, the center of the first hole 31*a* is overlapped with the center of the second hole 31*b*, The second fixing member 62 passes through the third hole 33*a* located in the middle and the fourth hole 33*b* located in the middle, to fixedly connect the first component 30*a* and the second component 30*b*. In addition, the center of the third hole 33*a* is overlapped with the center of the fourth hole 33*b*.

When an assembly error occurs or the door 20 deviates upward relative to the main body 10 due to various reasons after the household appliance has been used for a long time, the first fixing member 61 is controlled to loosen fixing of the first hole 31*a* and the second hole 31*b*, so that a relative position of the second hole 31*b* to the first hole 31*a* can be adjusted in the first direction m. In addition, the second fixing member 62 is controlled to cancel fixing of the third hole 33*a* and the fourth hole 33*b*, so that the second fixing member 62 passes through the third hole 34*a* and the fourth hole 34*b* at the lower portion, to fixedly connect the first component 30*a* and the second component 30*b*. Then, the first fixing member 61 passes through the first hole 31*a* and the second hole 31*b* having relative positions which have been adjusted, to fixedly connect the first component 30*a* and the second component 30*b*, In this case, the first component 30*a* is lowered, in the first direction m, by the distance L2 relative to the second component 30*b*, that is, the height of the door 20 is lowered by the distance L2 relative to the main body 10.

When the door 20 deviates downward relative to the main body 10 due to various reasons after an assembly error occurs or after the house appliance has been used for a long time, the second fixing member 62 passes through the third hole 32*a* and the fourth hole 32*b* that are located at the upper portion, to fixedly connect the first component and the second component 30*b*. Then, the first fixing member 61 passes through the first hole 31*a* and the second hole 31*b* having relative positions which have been adjusted, to fixedly connect the first component and the second component 30*b*. In this case, the first component 30*a* is lifted, in the first direction m, by the distance L1 relative to the second component 30*b*, that is, the height of the door 20 is increased by the distance L1 relative to the main body 10.

A value of the distance L1 by which the third hole 32*a* and the fourth hole 32*b* that are located at the upper portion deviate and a value of the distance L2 by which the third hole 34*a* and the fourth hole 34*b* that are located at the lower portion may be set according to specific cases. This is not limited in this technical embodiment. In another variant embodiment, the third hole group aa may alternatively include two third holes or at least four third holes. Correspondingly, the fourth hole group aa may alternatively include two fourth holes or at least four fourth holes. Larger quantities of third holes and fourth holes indicate more adjustable relative positions between the first component 30*a* and the second component 30*b*.

When an assembly error occurs or an upper portion of the door 20 deviates from the main body 10 due to various reasons after the house appliance has been used for a long time, the first fixing member 61 is controlled to loosen fixing of the first hole 31*a* and the second hole 31*b*. In addition, the second fixing member 62 is controlled to loosen fixing of the third hole 33*a* and the fourth hole 33*b*, so that the relative position of the fourth hole 33*b* to the third hole 33*a* is changed in the second direction n (the left direction in FIG. 7). In this way, the first component 30*a* and the second component 30*b* relatively rotate around the first fixing member 61, so that an upper portion of the door 20 is close to the main body 10, and the door 20 is restored from a tilted state to a correct state or a balanced position with an acceptable error. Then, the first component 30*a* and the second component 30*b* are fixedly connected by using the second fixing member 62 and the first fixing member 61. In this case, the second fixing member 62 is close to the right side of the third hole 33*a*.

When an assembly error occurs or a lower portion of the door 20 deviates from the main body 10 due to various reasons after the house appliance has been used for a long time, the relative position of the fourth hole 33*b* to the third hole 33*a* is changed in the second direction n (the left direction in FIG. 7), so that the lower portion of the door 20 is close to the main body 10, and the door 20 is restored from a tilted state to a correct state or a balanced position with an acceptable error. Then, the first component 30*a* and the second component 30*b* are fixedly connected by using the second fixing member 62 and the first fixing member 61. In this case, the second fixing member 62 is close to the left side of the third hole 33*a*.

In this embodiment, the third holes 32*a*, 33*a*, and 34*a* may be kidney-shaped holes. An extension direction of a major axis of the kidney-shaped hole is the second direction n. Optionally, the first direction m is perpendicular to the second direction n. In this case, the relative positions between the fourth holes 32*b*, 33*b*, and 34*b* and the corresponding third holes 32*a*, 33*a*, and 34*a* can be changed better by using the first fixing member 61 as a center. However, a distance between a position of the kidney-shaped hole and the center of the first hole 31*a* varies, so that changes in relative positions of the fourth holes 32*b*, 33*b*, and 34*b* relative to the third holes 32*a*, 33*a*, and 34*a* are relatively limited, thereby limiting a rotation amplitude between the first component 30*a* and the second component 30*b*.

In addition, the third holes 32*a*, 33*a*, and 34*a* may be arcuate holes, and major axes of the arcuate holes are arc segments surrounding the first hole 31*a* As compared with the kidney-shaped hole, a distance between a position of arcuate hole and the center of the first hole 31*a* does not vary, so that the relative positions between the fourth holes 32*b*, 33*b*, and 34*b* and the corresponding third holes 32*a*, 33*a*, and 34*a* can be changed better by using the first fixing member 61 as a center. In addition, the rotation amplitude between the first component 30*a* and the second component 30*b* is not limited.

Both the first fixing member 61 and the second fixing member 62 are screws or bolts, to fix the first component 30*a* and the second component 30*b*. The second hole 31*b* may be a threaded hole coordinating with the first fixing member 61, or may be a through hole, and a fixed connection is implemented by placing a bolt coordinating with the through hole. The fourth holes 32*b*, 33*b*, and 34*b* may be threaded holes coordinating with the second fixing member 62, or may be through holes, and a fixed connection is implemented by placing bolts coordinating with the through holes.

Still referring to FIG. 5 and FIG. 6, the centers of the three third holes 32*a*, 33*a*, and 34*a* are on a same line, and the three third holes 32*a*, 33*a*, and 34*a* extend in the first direction m. In addition, the major axis of the first hole 31*a* and centers of the three third holes 32*a*, 33*a*, and 34*a* are also on a same line. Correspondingly, the center of the second hole 31*b* and the centers of the three fourth holes 32*b*, 33*b*, and 34*b* are on a same line, and the second hole 31*b* and the three fourth holes 32*b*, 33*b*, and 34*b* extend in the first direction m.

If the centers of the third holes 32*a*, 33*a*, and 34*a* are on the same line, on one hand, it is convenient to make a hole on the first component 30*a* and fix the first component 30*a* to the second component 30*b*. On the other hand, when the second hole 31*b* changes the relative positions between the first component 30*a* and the second component 30*b* in the first direction m, the centers of the fourth holes 32*b*, 33*b*, and 34*b* can be overlapped with the centers of the third holes 32*a*, 33*a*, and 34*a*. This facilitates the position adjustment between the first component 30*a* and the second component 30*b*.

In this embodiment, the first hole 31*a* and the third holes 32*a*, 33*a*, and 34*a* are provided on the first component 30*a*, and the second hole 31*b* and the fourth holes 32*b*, 33*b*, and 34*b* are provided on the second component 30*b*. It should be understood that in another variant embodiment, the positions of the first hole 31*a* and the second hole 31*b* may be exchanged, the positions of the third holes 32*a*, 33*a*, and 34*a* and the positions of the fourth holes 32*b*, 33*b*, and 34*b* may also be exchanged. In addition, the first component 30*a* may be disposed on the main body 10, and the second component 30*b* is fixedly disposed on the door 20.

FIG. 9 to FIG. 12 are diagrammatic illustrations of another connection mechanism 30.

In this embodiment, a first component 30*a* is further provided with a first positioning hole 35*a*, and a second component 30*b* is provided with a second positioning hole 35*b* corresponding to the first positioning hole 35*a*. The connection mechanism 30 further includes a positioning member (not shown). When the first positioning hole 35*a* is aligned with the second positioning hole 35*b*, the positioning member can be inserted into the first positioning hole 35*a* and the second positioning hole 35*b*, to prevent the first component 30*a* and the second component 30*b* from relatively moving, thereby avoiding changes in relative positions between the first component 30*a* and the second component 30*b*.

The first positioning hole 35*a* is located between a first hole 31*a* and third holes 32*a*, 33*a*, and 34*a*. The second positioning hole 35*b* is located between a second hole 31*b* and fourth holes 32*b*, 33*b*, and 34*b*.

In addition, when the first positioning hole 35*a* is aligned with the second positioning hole 35*b*, a center of the first hole 31*a* is overlapped with a center of the second hole 31*b*, and a center of the third hole 33*a* located in the middle is overlapped with a center of the corresponding fourth hole 33*b*. A first fixing member 61 is suitable to pass through the first hole 31*a* and the second hole 31*b*, to fixedly connect the first component 30*a* and the second component 30*b*. A second fixing member 62 is suitable to pass through the third hole 33*a* and the fourth hole 33*b*, to fixedly connect the first component 30*a* and the second component 30*b*. In this case, the first component 30*a* and the second component 30*b* are at initial relative positions.

The first positioning hole 35*a*, the second positioning hole 35*b*, and a positioning member are disposed in such a way that the relative positions between the first component 30*a* and the second component 30*b* can be fixed before the connection mechanism 30 is assembled, thereby facilitating fixed mounting of the first component 30*a* and the second component 30*b*.

The positioning member is a removable positioning member. After the first component 30*a* and the second component 30*b* are fixedly mounted, the positioning member is pulled out of the first positioning hole 35*a* and the second positioning hole 35*b*, so that the positioning member can be repeatedly used. In addition, the positioning member does not affect adjustment of the relative positions between the first component 30*a* and the second component 30*b*.

In this embodiment, the first positioning hole 35*a* and the second positioning hole 35*b* have the same shape and size. An outline of the positioning member and the first positioning hole 35*a* also have the same shape and size. In this way, when the positioning member is inserted into the first positioning hole 35*a* and the second positioning hole 35*b*, there will be no gap between the first positioning hole 35*a* and the outline of the positioning member and between the second positioning hole 35*b* and the outline of the positioning member. A problem that the first hole 31*a* and the second hole 31*b* cannot be aligned, and the third hole 33*a* and the fourth hole 33*b* cannot be aligned because the first component 30*a* and the second component 30*b* relatively move due to existence of a gap will not be caused.

Figure 9:
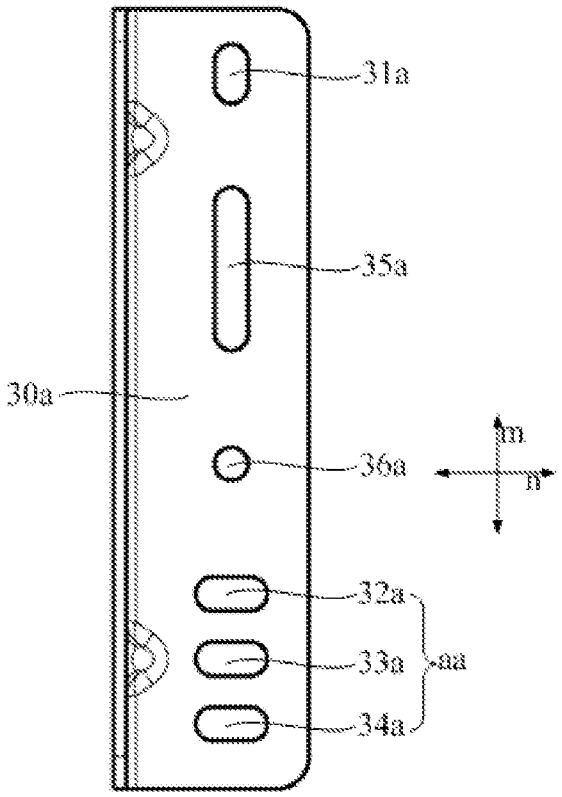
FIG. 9 is an elevational view of a first component in another connection mechanism according to a specific embodiment of the present invention.
Figure 10:
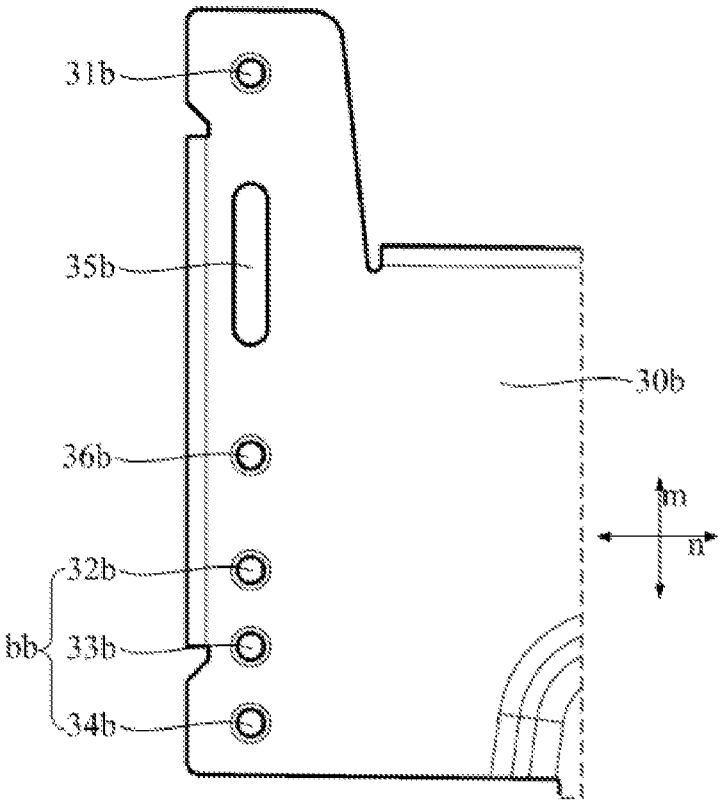
FIG. 10 is an elevational view of a second component in another connection mechanism according to a specific embodiment of the present invention.
Figure 11:
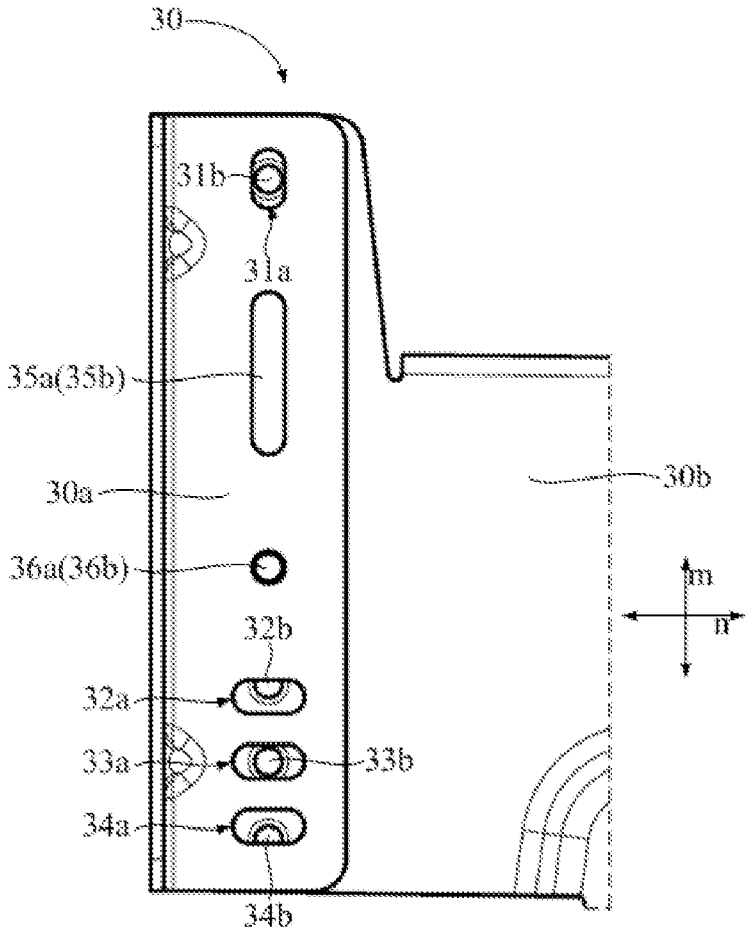
FIG. 11 is an elevational view showing that the first component shown in FIG. 9 and the second component shown in FIG. 10 are fixedly connected, in which a first fixing member, a second fixing member, and a third fixing member are not shown.
Figure 12:
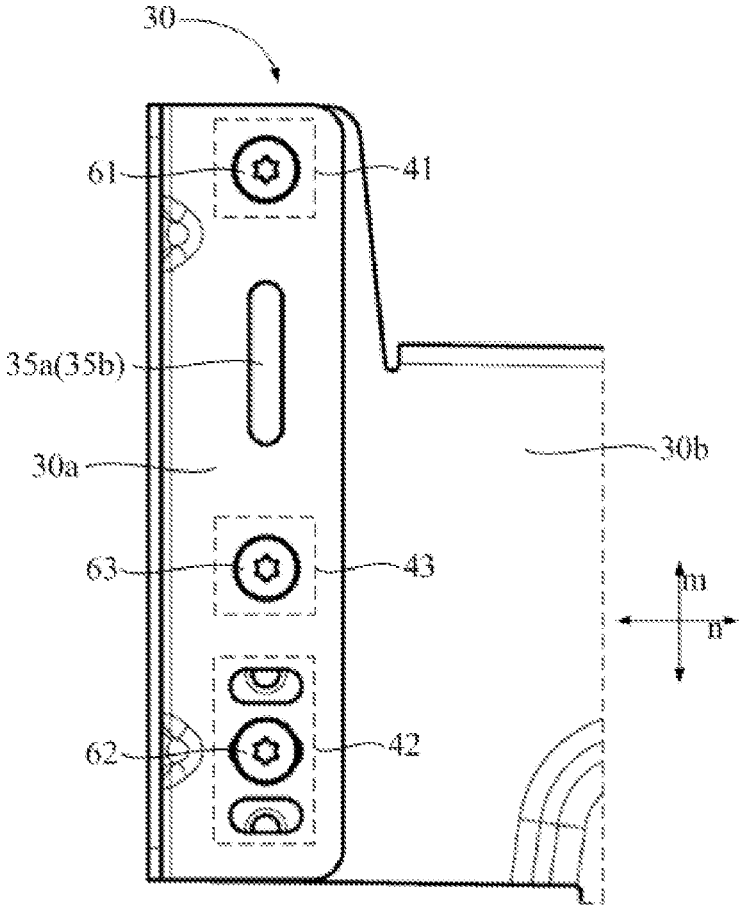
FIG. 12 is an elevational view showing that the first component shown in FIG. 9 and the second component shown in FIG. 10 are fixedly connected, in which a first fixing member, a second fixing member, and a third fixing member are shown.

As shown in FIG. 9 and FIG. 10, the first positioning hole 35*a* and the second positioning hole 35*b* are both kidney-shaped holes. Therefore, it can be avoided that the first hole 31*a* and the second hole 31*b* cannot be aligned, and the third hole 33*a* and the fourth hole 33*b* cannot be aligned because the first component 30*a* and the second component 30*b* relatively rotate, after the positioning member is inserted into the first positioning hole 35*a* and the second positioning hole 35*b*, by using the positioning member as a center.

In another variant embodiment, the first positioning hole 35*a* and the second positioning hole 35*b* are non-round holes, to prevent the first component 30*a* and the second component 30*b* from relatively rotating. For example, the first positioning hole 35*a* and the second positioning hole 35*b* are polygonal holes such as triangles.

In this embodiment, major axes of the first positioning hole 35*a* and the second positioning hole 35*b* extend in the first direction m. In addition, the major axis of the first positioning hole 35*a* is located in a direction of a connection line between the first hole 31*a* and the third holes 32*a*, 33*a*, and 34*a*, or is parallel to a direction of a connection line between the first hole 31*a* and the third holes 32*a*, 33*a*, and 34*a*. The major axis of the second positioning hole 35*b* is located in a direction of a connection line between the second hole 31*b* and the fourth holes 32*b*, 33*b*, and 34*b*, or is parallel to a direction of a connection line between the second hole 31*b* and the fourth holes 32*b*; 33*b*, and 34*b*.

When the relative positions of the second component 30*b* relative to the first component 30*a* in the first direction m need to be adjusted, inserting a positioning member having a constant thickness and a relatively small width into the first positioning hole 35*a* and the second positioning hole 35*b* can define relative positions between the first component 30*a* and the second component 30*b* in the second direction n. In the first direction m, the first component 30*a* and the second component 30*b* can relatively move. In this case, it facilitates adjustment of the relative positions between the first component 30*a* and the second component 30*b* in the first direction m.

Still referring to FIG. 9 and FIG. 10, the first component 30*a* is further provided with a first initial fixing hole 36*a*, and the second component 30*b* is further provided with a second initial fixing hole 36*b* disposed corresponding to the first initial fixing hole 36*a*. The connection mechanism 30 further includes a third fixing member 63 (see FIG. 12).

When the positioning member is inserted into the first positioning hole 35*a* and the second positioning hole 35*b* to limit the first component 30*a* and the second component 30*b* at the initial relative positions, the first initial fixing hole 36*a* is overlapped with the second initial fixing hole 36*b*. In this case, the third fixing member 63 is suitable to pass through the first initial fixing hole 36*a* and the second initial fixing hole 36*b*, to pre-fix the first component 30*a* and the second component 30*b*. Based thereupon, the first component 30*a* and the second component 30*b* are fixed by using the first fixing member 61 and the second fixing member 62, thereby further facilitating fixing of the first component 30*a* and the second component 30*b*.

The first initial fixing hole 36*a*, the second initial fixing hole 36*b*, and the third fixing member 63 form an initial fixing mechanism 43 of the connection mechanism 30. The first component 30*a* and the second component 30*b* are pre-fixed by using the initial fixing mechanism 43, and the first fixing mechanism 41 and the second fixing mechanism 42 again fix the first component 30*a* and the second component 30*b*. In this way, the first component 30*a* and the second component 30*b* can be effectively prevented from becoming loose, thereby improving connection strength of the first component 30*a* and the second component 30*b*.

In addition, after the first component 30*a* and the second component 30*b* are pre-fixed, it also facilitates the first fixing mechanism 41 and the second fixing mechanism 42 to fix the first component 30*a* and the second component 30*b*.

It should be noted that the initial fixing mechanism 43 only fixes the first component 30*a* and the second component 30*b* when the first component 30*a* and the second component 30*b* are at the initial relative positions. When the relative positions between the first component 30*a* and the second component 30*b* need to be adjusted, the third fixing member 63 needs to be detached from the first initial fixing hole 36*a* and the second initial fixing hole 36*b*. After the relative positions between the first component 30*a* and the second component 30*b* are adjusted, the first component 30*a* and the second component 30*b* do not need to be fixed by using the initial fixing mechanism 43.

In this implementation, the initial fixing mechanism 43 is located between the first fixing mechanism 41 and the second fixing mechanism 42. That is, the first initial fixing hole 36*a* is located between the first hole 31*a* and the third holes 32*a*, 33*a*, and 34*a*, and second initial fixing hole 36*b* is located between the second hole 31*b* and the fourth holes 32*b*, 33*b*, and 34*b*.

The third fixing member 63 is a screw or a bolt.

Although the present invention has been disclosed above, the present invention is not limited thereto. A person skilled in the art can make various changes and modifications without departing from the spirit and scope of the present invention. Therefore, the protection scope of the present invention should be subject to the scope defined by the claims.

The invention claimed is:

1. A household appliance, comprising:

a main body;

a door connected to said main body; and a connection mechanism configured to fix said door to said main body, said connection mechanism including first and second components and first and second fixing mechanisms configured to fix said first and second components;

said first fixing mechanism having a first hole located on said first component, a second hole located on said second component, and a first fixing member passing through said first hole and said second hole for fixing said first component and said second component;

said second fixing mechanism having a group of third holes located on said first component, a group of fourth holes located on said second component, and a second fixing member;

said third holes being disposed at intervals in a first direction, said fourth holes being disposed at intervals in said first direction, said third holes and said fourth holes being disposed in such a manner that upon said second fixing member passing through any one of said third holes and any one of said fourth holes corresponding to said third holes, a distance is defined between centers of a remainder of said third holes and centers of a remainder of said corresponding fourth holes in said first direction; and said third holes being elongated holes extending in a second direction, and said fourth holes being suitable for adjusting positions relative to said third holes in said second direction, permitting said first component and said second component to rotate relative to each other about said first fixing member for adjusting a position of said door relative to said main body upon said door being closed.

2. The household appliance according to claim 1, wherein said centers of said third holes are all disposed along one line and extend in said first direction.

3. The household appliance according to claim 1, wherein said first hole is a kidney-shaped hole having a major axis extending in said first direction.

4. The household appliance according to claim 3, wherein said major axis of said first hole and said centers of said third holes are all disposed along one line.

5. The household appliance according to claim 1, wherein said first direction is perpendicular to said second direction.

6. The household appliance according to claim 1, wherein:

said third holes are kidney-shaped holes having major axes defining extension directions in said second direction, or said third holes are arcuate holes bending toward said first hole and having major axes defining arc segments surrounding said first hole.

7. The household appliance according to claim 1, wherein a screw or a bolt is provided as at least one of said first fixing member or said second fixing member.

8. The household appliance according claim 1, wherein:

said first component has a first positioning hole;

said second component has a second positioning hole corresponding to said first positioning hole;

said first positioning hole and said second positioning hole, when aligned with each other, are suitable for receiving a removable positioning member; and when said first positioning hole and said second positioning hole are aligned with each other, said first fixing member is suitable for passing through said first hole and said second hole, and said second fixing member is suitable for passing through one of said third holes and one of said corresponding fourth holes, for placing said first component and said second component at initial relative positions.

9. The household appliance according to claim 8, wherein said first positioning hole and said second positioning hole are both located between said first fixing mechanism and said second fixing mechanism.

10. The household appliance according to claim 8, wherein said first positioning hole has a non-round shape.

11. The household appliance according to claim 10, wherein said first positioning hole has a kidney-shape.

12. The household appliance according to claim 11, wherein said first positioning hole has a major axis extending in said first direction.

13. The household appliance according to claim 11, wherein:

a center of said first hole and said centers of said third holes are all disposed along one line and said first hole and said third holes extend in said first direction; and said first positioning hole has a major axis located along a line connecting said center of said first hole and said centers of said third holes, or is parallel to a line connecting said center of said first hole and said centers of said third holes.

14. The household appliance according to claim 8, wherein said first positioning hole and said second positioning hole have identical shapes and sizes.

15. The household appliance according to claim 8, wherein a center of said first hole overlaps a center of said second hole, at said initial relative positions.

16. The household appliance according to claim 8, wherein said second fixing member is suitable for passing through one third hole located centrally in said group of third holes and a corresponding fourth hole, at said initial relative positions.

17. The household appliance according to claim 16, wherein a center of said third hole located centrally in said second direction overlaps a center of said corresponding fourth hole, at said initial relative positions.

18. The household appliance according to claim 8, wherein said connection mechanism includes an initial fixing mechanism having a first initial fixing hole located on said first component and a second initial fixing hole located on said second component, and said first initial fixing hole is overlapped by said second initial fixing hole to receive a third fixing member, at said initial relative positions.

19. The household appliance according to claim 18, wherein said initial fixing mechanism is located between said first fixing mechanism and said second fixing mechanism.

20. The household appliance according to claim 1, wherein said second fixing member can pass through only one of said third holes and only one of said fourth holes.

* * * * *